United States Patent [19]

Boxall et al.

[11] Patent Number: 4,905,861

[45] Date of Patent: Mar. 6, 1990

[54] LIDDED CONTAINERS

[75] Inventors: Charles W. Boxall, Colsterworth; John R. Calvert, Epping; Brian Edwards, Oakham; Martyn O. Rowlands, Epping; Christopher H. Sworn, Oakham, all of Great Britain

[73] Assignee: Reed Packaging Limited, Maidstone, United Kingdom

[21] Appl. No.: 313,131

[22] PCT Filed: Jan. 7, 1988

[86] PCT No.: PCT/GB88/00008

§ 371 Date: Feb. 2, 1989

§ 102(e) Date: Feb. 2, 1989

[87] PCT Pub. No.: WO88/05015

PCT Pub. Date: Jul. 14, 1988

[30] Foreign Application Priority Data

Jan. 12, 1987 [GB] United Kingdom ..... 8700600

[51] Int. Cl.[4] ..... B65D 43/06

[52] U.S. Cl. ..... 220/266; 220/284; 220/306; 220/307; 220/73

[58] Field of Search ..... 220/265, 266, 277, 284, 220/306, 307, 73, 74, DIG. 14, DIG. 25; 215/250, 253

[56] References Cited

U.S. PATENT DOCUMENTS

| | | | |
|---|---|---|---|
| 3,406,817 | 10/1968 | Lane et al. | 206/408 |
| 3,609,263 | 9/1971 | Clementi | 220/306 |
| 3,811,597 | 5/1974 | Frankenberg et al. | 220/284 |
| 4,165,018 | 8/1979 | Giggerd | 220/284 |
| 4,177,930 | 12/1979 | Crisci | 220/284 |
| 4,347,943 | 9/1982 | Hackwell et al. | 220/306 |
| 4,530,442 | 7/1985 | Vogel, Jr. et al. | 220/354 |

FOREIGN PATENT DOCUMENTS

| | | |
|---|---|---|
| 8616755 | 10/1986 | Fed. Rep. of Germany . |
| 1194685 | 11/1959 | France . |

*Primary Examiner*—Stephen Marcus
*Assistant Examiner*—Nova Stucker
*Attorney, Agent, or Firm*—Brady, O'Boyle & Gates

[57] ABSTRACT

A lidded container made of plastics material comprises a body (10) with a top rim (11) and a lid (12) with a flange (18) for sealing engagement inside the rim (11). The lid (12) has a web (17) part carrying said flange (18), which depends therefrom, and also carrying a depending skirt (16) for surrounding the outside of the rim (11), said skirt (16) having a plurality of inwardly-directed projections (21) each engageable in latching relationship in a recess (31) on the outside of the rim (11), and said web part (17) having apertures (24) corresponding to said projections (21), whereby a tool can be inserted through each aperture (24) to disengage the corresponding projection (21) from said recess (31).

6 Claims, 2 Drawing Sheets

LIDDED CONTAINERS

Figure 1:
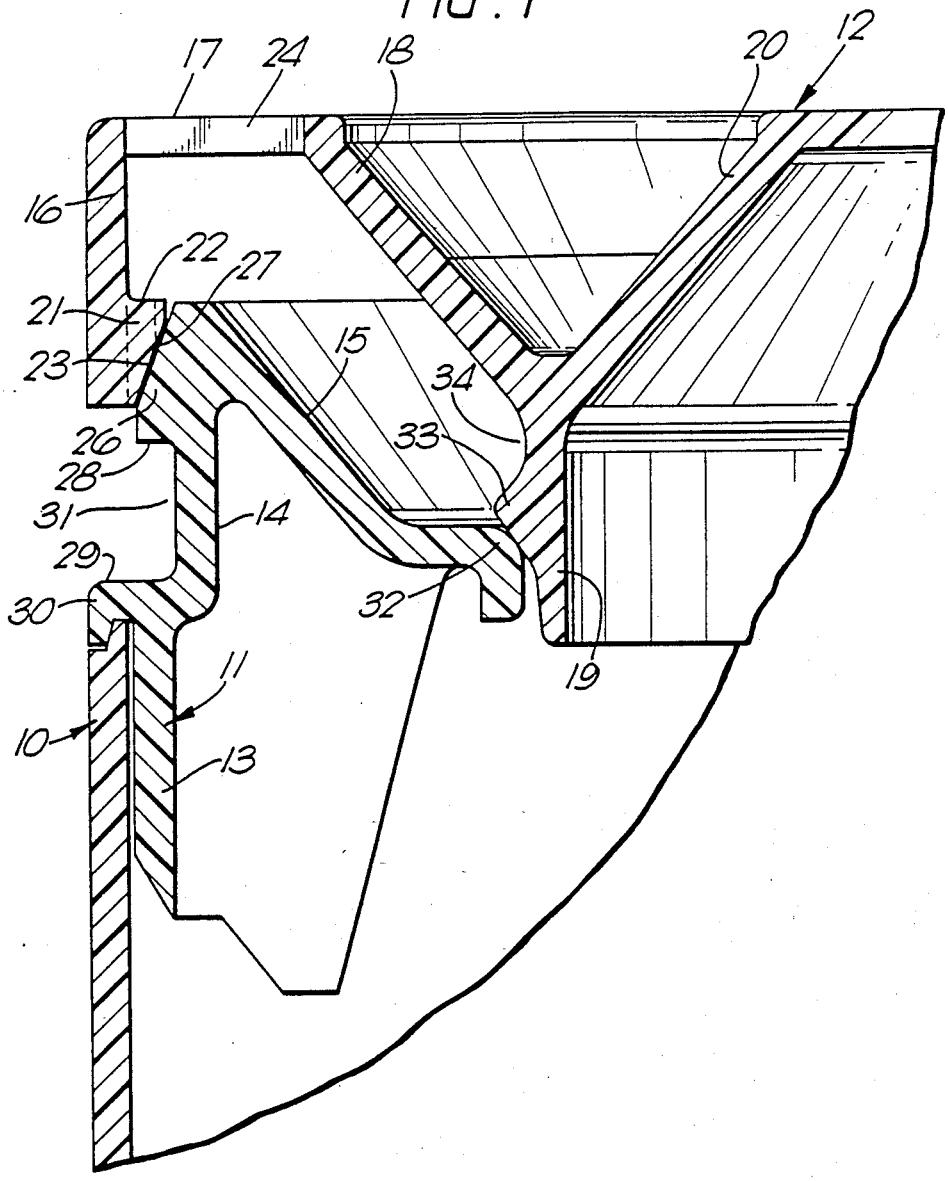

This invention is concerned with lidded containers, and relates particularly, but not exclusively, to lidded containers for paint.

Paint has conventionally been supplied in metal containers having metal lids which fit inside the tops of the containers. However, metal containers have various disadvantages, and in particular are liable to damage if subjected to impact, e.g. by dropping, during transit. Also, such impact may cause displacement of the lids, and, in order to minimise the risk of such displacement, it is necessary to provide clips or boxes to retain the lids. Unfortunately, such clips, (which are made as separate components), or boxes complicate the packaging operation, and involve substantial extra costs.

Making the container of a plastics material instead of metal provides the possibility of significantly reducing the risk of impact damage. The desirability of providing means for minimising risk of displacement of the lids would, however, still exist, and the present invention seeks to deal with this by providing a plastics container having a simple and effective lid-retaining means.

According to the present invention, there is provided a lidded container made of plastics material, said container comprising a body with a top rim and a lid with a flange for sealing engagement inside said rim, characterised in that the lid has a web part carrying said flange, which depends therefrom, and also carrying a depending skirt for surrounding the outside of the rim, said skirt having a plurality of inwardly-directed projections each engageable in latching relationship in a recess on the outside of the rim, and said web part having apertures corresponding to said projections, whereby a tool can be inserted through each aperture to disengage the corresponding projection from said recess.

Any suitable kind of plastics material may be employed, but the plastics material should be of a resiliently flexible nature. The plastics material should also be resistant to materials to be stored in the container. For example, if the container is for gloss paint, the plastics material should be resistant to the solvent in the paint. For this purpose, we have found that a polyester plastics material is particularly suitable.

The rim may be inwardly or outwardly projecting but preferably has an inwardly-directed flange, and it is against this flange that the lid's web-borne flange seats. The whole rim portion of the container may be made as a separate part, which is then securely mounted (by welding, say) on to the upper edge of the container body.

There are preferably at least three of the inwardly-directed projections, and (of course) a corresponding number of apertures.

Preferably, at each aperture said skirt has thinner and therefore weaker portions (e.g. provided by internal or external grooves) on each side of each projection, whereby leverage by said tool can cause the skirt to fracture and the part of the skirt between the thinner portions (together with the associated projection) to become detached from the lid.

The projections and the rim are preferably so formed that, when the lid is pressed on to the container body, the projections ride over a rib on the outside of the rim before entering said recess, but that the projections cannot ride over the rib in the reverse direction.

It will therefore be seen that the container has releasable lid-retaining or—latching means near the outside and sealing means between the lid and rim spaced inwardly from the lid retaining means.

The container can be of any shape and size, the rim portion (if separate) and the lid then matching this. Generally, however, it is most convenient—equally for paint containers—if the whole is eventually cylindrical, with the lid therefor annular and the rim annular.

Figure 2:
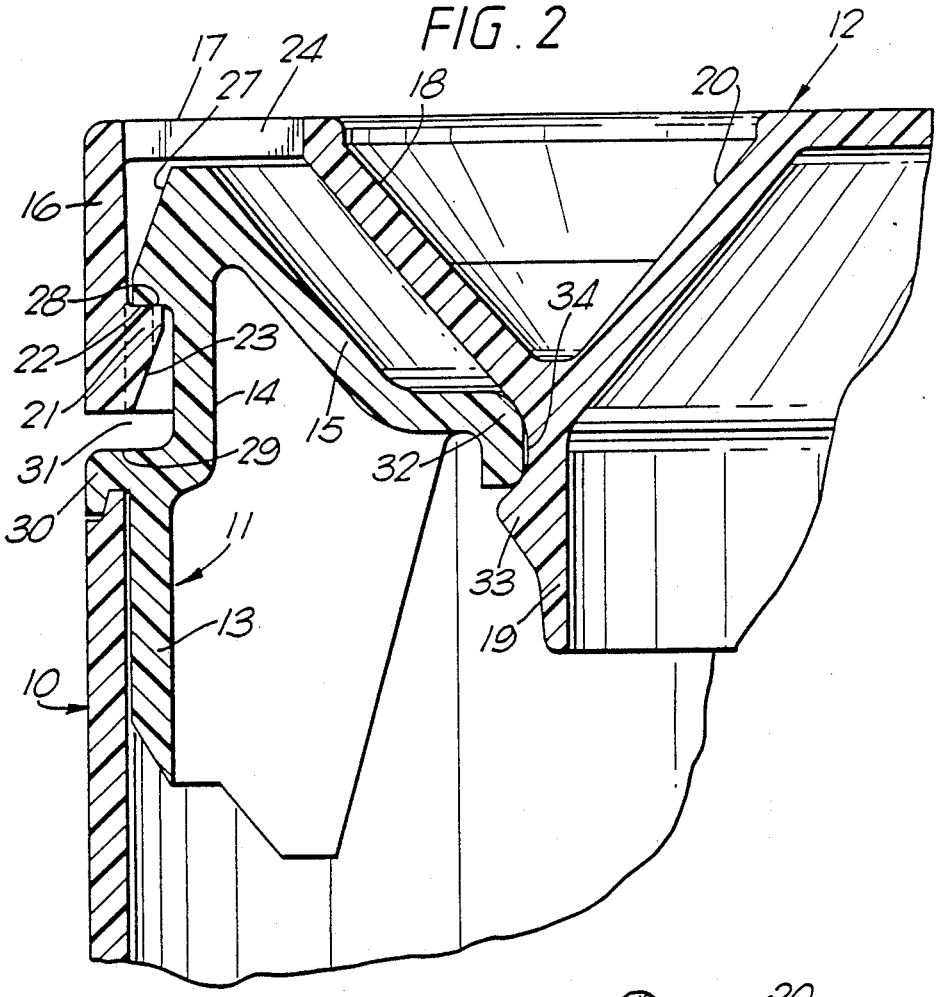
Figure 3:
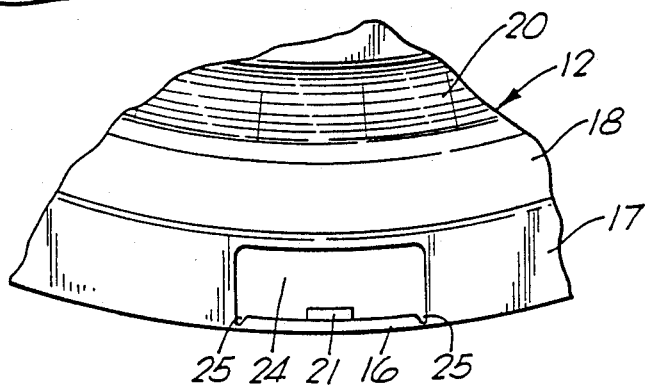

The following is a description, though only by way of example, of an embodiment of the invention, reference being made to the accompanying schematic drawings, in which FIG. 1 is a section view through part of the top of a container with a lid resting thereon but not in its sealed position, FIG. 2 is a sectional view similar to FIG. 1 but with the lid closed into its sealed position, and FIG. 3 is a plan view, on a smaller scale, of part of the top of the lid.

The container shown in the drawings comprises three injection-moulded plastics components, namely a container body 10, a rim member 11 welded into the top of the container body so as to form part therof, and a lid 12.

The body 10 is of cylindrical shape, and the rim member 11 is of annular form, having a lowermost flange 13 welded inside the top of the container, an upstanding flange 14, and an inwardly projecting flange 15.

The lid 12 is circular, and has an outer flange 16 depending from the outside of an annular web 17. An inclined inner flange 18 depends from the inside of the web 17. From the bottom of the flange 18, a sealing flange 19 extends downwards, and a central part 20 of the lid extends radially inwards. In the drawings, the central part 20 is shown with a domed configuration, but it could be of a different shape, e.g. it could be of flat disc-like configuration.

As best seen in conjunction with FIG. 3, the outer flange 16 has a plurality (in practice, at least three) of internal projections 21 equally spaced circumferentially of the flange 16. Each projection 21 has an upper face 22 disposed in a plane normal to the lid axis, and an inclined lower face 23. The web 17 has apertures 24 at positions corresponding to the projections 21. Each aperture 24 extends circumferentially of the lid over and on each side of its corresponding projection 21. At each end of each aperture 24, the outer flange 16 is weakened throughout its depth by an internal groove 25 (see FIG. 3).

The rim flange 14 has an outwardly-extending annular rib 26 with an inclined upper face 27 and a lower face 28 disposed in a plane normal to the container axis. In conjunction with an upper face 29 on an external annular projection 30 on the rim members 11, the face 28 defines an annular recess 31 on the outside of the rim members.

The inwardly projecting flange 15 on the rim member is downwardly inclined for the greater part of its width, but terminates in a sealing portion 32 extending first radially and finally downwards.

The sealing flange 19 on the lid has an outwardly-extending extending annular protrusion 33 which is spaced below the flange 18 and which, together with the flange 18, defines an annular groove 34.

The manner in which the lid closes the container will be evident from a comparison of FIGS. 1 and 2. In FIG. 1, the lid is simply lying on top of the rim member. To close the container, the lid is pressed down into the position of FIG. 2. Owing to the inclined faces 23 and 27, and to the resilience of the plastics material, when the lid is pressed down the projections 21 ride over the rib 26, and the projections enter the recess 31. The faces 22 and 28 then positively prevent removal of the lid, except as hereinafter described. At the same time, the annular protrusion 33 rides over the sealing portion 32, which enters the groove 34 to provide sealing engagement between the lid and the rim member.

In order to remove the lid, a tool, such as a screwdriver, is inserted into the apertures 24, and used as a lever to break off the parts of the flange 16 between the grooves 25. Those parts take with them the projections 21, and the positive latched or locked relationship between the lid and the rim members ceases to exist. The tool is then inserted through one or more of the apertures 24 and between the flanges 15 and 18, and used as a lever to move the annular protrusion 33 up past the sealing portion 32, when the lid is free to be removed. The lid can, of course, be replaced, when the sealing arrangement (but not the locking arrangement) will be operative.

The provision of separate locking and sealing arrangements enables both to serve their desired purposes without conflict. The construction described can also be made without requiring specially complicated injection moulding tools.

Although the invention has been described herein in terms of containers for paint, there is, of course, no reason why the containers of this invention should not be used for any other materials that needs to be stored securely but releasably.

We claim:

1. A lidded container made of plastics material, said container comprising a body with a top rim and a lid with a flange for sealing engagement inside said rim, characterised in that the lid has a web part carrying said flange, which depends therefrom, and also carrying a depending skirt for surrounding the outside of the rim, said skirt having a plurality of inwardly-directed projections each engageable in latching relationship in a recess on the outside of the rim, and said web part having apertures corresponding to said projections, whereby a tool can be inserted through each aperture to disengage the corresponding projection from said recess.

2. A lidded container according to claim 1 characterised in that the rim has an inwardly-directed flange against which the flange of the lid seats.

3. A lidded container according to claim 1 characterised in that the container has a rim portion made as a separate part, which is mounted on the upper edge of the container body.

4. A lidded container according to claim 1 characterised in that there are at least three of said inwardly-directed projections and a corresponding number of apertures.

5. A lidded container according to claim 1 characterised in that at each aperture said skirt has thinner and therefore weaker portions (e.g. provided by internal grooves) on each side of each projection, whereby leverage by said tool can cause the skirt to fracture and the part of the skirt between the thinner portions (together with the associated projection) to become detached from the lid.

6. A lidded container according to claim 1 characterised in that the projections and the rim are so formed that, when the lid is pressed on to the container body, the projections ride over a rib on the outside of the rim before entering said recess, but that the projections cannot ride over the rib in the reverse direction.

* * * * *